US008186063B2

(12) United States Patent
Clarke

(10) Patent No.: US 8,186,063 B2
(45) Date of Patent: May 29, 2012

(54) RAZORS

(75) Inventor: Sean Peter Clarke, Oxfordshire (GB)

(73) Assignee: The Gillette Company, Boston, MA (US)

( * ) Notice: Subject to any disclaimer, the term of this patent is extended or adjusted under 35 U.S.C. 154(b) by 729 days.

(21) Appl. No.: 11/659,678

(22) PCT Filed: Aug. 10, 2005

(86) PCT No.: PCT/GB2005/003143

§ 371 (c)(1),
(2), (4) Date: Jan. 15, 2008

(87) PCT Pub. No.: WO2006/016159

PCT Pub. Date: Feb. 16, 2006

(65) Prior Publication Data

US 2008/0289185 A1 Nov. 27, 2008

(30) Foreign Application Priority Data

Aug. 13, 2004 (GB) ..... 0418180.6

(51) Int. Cl.
*B26B 19/44* (2006.01)

(52) U.S. Cl. ..... 30/41; 30/41.5; 30/152

(58) Field of Classification Search ..... 30/142, 30/143, 162, 125, 317, 334, 41.5, 41, 152, 30/45, 34.05
See application file for complete search history.

(56) References Cited

U.S. PATENT DOCUMENTS

| | | | | |
|---|---|---|---|---|
| 2,281,250 | A | 4/1942 | Ruskin | |
| 2,307,471 | A | 1/1943 | Schaffer et al. | |
| 3,176,392 | A | 4/1965 | Gwinn | |
| 5,121,541 | A | 6/1992 | Patrakis | |
| 5,337,478 | A | 8/1994 | Cohen et al. | |
| 6,126,669 | A | 10/2000 | Rijken et al. | |
| 6,402,410 | B1 | 6/2002 | Hall et al. | |
| 6,460,251 | B1 * | 10/2002 | Orloff | 30/41.7 |
| 6,560,875 | B1 | 5/2003 | Eichhorn et al. | |
| 7,103,977 | B2 * | 9/2006 | Guimont | 30/41 |
| 7,155,828 | B2 * | 1/2007 | Guimont et al. | 30/41 |
| 7,234,240 | B2 * | 6/2007 | Peter et al. | 30/41 |
| 7,402,165 | B2 * | 7/2008 | Saitou et al. | 606/133 |
| 7,415,767 | B2 * | 8/2008 | Saker et al. | 30/34.05 |
| 7,596,866 | B2 * | 10/2009 | Saker et al. | 30/45 |
| 2002/0189102 | A1 * | 12/2002 | Orloff | 30/41.7 |
| 2004/0098862 | A1 * | 5/2004 | Orloff | 30/41.7 |

FOREIGN PATENT DOCUMENTS

| | | | |
|---|---|---|---|
| EP | 1252980 | A2 | 10/2002 |
| GB | 690828 | | 4/1953 |
| GB | 2402096 | A | 12/2004 |
| WO | WO 00/47374 | A1 | 8/2000 |
| WO | WO 2004/073941 | A1 | 9/2004 |

* cited by examiner

*Primary Examiner* — Boyer D Ashley

*Assistant Examiner* — Omar Flores Sanchez

(74) *Attorney, Agent, or Firm* — Austin P. Wang; Kevin C. Johnson; Steven W. Miller

(57) ABSTRACT

A razor, especially a safety razor, comprises a fluid delivery system including a pump (24) for conducting a fluid, such as a lubricant, from a reservoir (25) for application to the skin, and a control device (16) for actuating the pump (24) when the razor is brought into contact with the skin by a person holding the razor, and deactuating the pump (24) after a certain time of actuation, e.g. 0.1 to 2 seconds. The control device is arranged to ensured a delay of 1 to 10 seconds between successive actuations, and so that the pump is actuated only every second third or fourth shaving stroke.

7 Claims, 7 Drawing Sheets

Pulse Generator and Pump Drive

RAZORS

FIELD OF THE INVENTION

This invention relates to razors. It is especially applicable to a safety razor, i.e. a razor with one or more blades or foils with sharp cutting edges, although the invention in its broadest concept can also be applied to dry razors, that is razors in which a foil and an undercutter are moved relative to each other for severing hairs with a shearing action. The invention is particularly described herein embodied in a safety razor.

BACKGROUND OF THE INVENTION

There have been many proposals to provide a safety razor with a dispensing system for delivering to the skin during shaving a shaving enhancement product, such as a shaving foam or other lubricating fluid, the product being stored within a reservoir ready for use. According to some of these prior proposals the reservoir is accommodated within the razor handle, although other arrangements have been suggested, such as clipping the razor structure to a pressurised container, as described in our earlier application No. WO-A-00/47374 (Simms). There is generally included in the delivery system a device to control the supply of fluid product from the reservoir in the course of shaving, such as a valve to release the fluid from the reservoir in which it is held under pressure. The valve may be arranged to be actuated by applying the blade unit of the razor against the skin, as with the razor described in the aforementioned application No. WO-A-00/47374, although in other constructions a separate operating button is arranged to be manually depressed using a finger of the hand in which the razor is held. Disclosed in U.S. Pat. No. 5,337,478 (Cohen et al) is a safety razor having a pressurised reservoir of shaving foam accommodated in the handle and having a valve operable to release the shaving foam for delivery to the blade unit of the razor to be dispensed at a skin contacting surface of the blade unit. A solenoid is provided for operating the valve, the solenoid being powered by a battery located in a battery housing attached to the base of the handle, and actuation of the solenoid is controlled by an electric switch disposed in the razor head so that the switch is closed, and hence the solenoid is actuated to open the valve, when the head is pressed against the skin for performing a shaving stroke. With this system, and with other prior art arrangements, it is difficult to control the delivery of fluid product for application to the skin so as to ensure a satisfactory metering rate without excessive amounts of product being dispensed. Furthermore, with some arrangements fluid may continue to be dispensed, at least for a short time after the blade unit has been moved away from the skin, and this can be convenient, especially if it occurs after shaving is completed. U.S. Pat. No. 3,176,392 (Gwinn) describes an electric dry razor with a reservoir for a liquid glide agent which can be dispensed at the will of the user. The liquid can be under pressure in the reservoir and dispensed by manual operation of a valve actuated by a lever on the side of the razor housing. As an alternative it is suggested to use the razor motor to drive a pump to dispense the liquid. These proposals suffer the same drawbacks as those discussed above.

SUMMARY OF THE INVENTION

The present invention addresses the drawbacks of the known dispensing systems and provided in accordance with the invention is a razor comprising a fluid delivery system for conducting fluid from a reservoir to a dispensing opening for application to the skin during shaving, the delivery system including an electrically actuable dispensing device to control delivery of the fluid, and a control device for controlling actuation of the dispensing device, wherein the control device is arranged to produce a control signal to actuate the dispensing device when the razor is brought into contact with the skin for shaving and to deactuate the dispensing device after a predetermined period of actuation.

By limiting the time for which the dispensing device is actuated each time the razor is brought into contact with the skin a highly effective metering of fluid for application to the skin is achieved during shaving and, in particular, the delivery of excessive amounts of fluid can be avoided.

The invention is, in one preferred embodiment, embodied in a safety razor including a handle in which the reservoir is housed, and a blade unit with one or more blades carried on the handle, the dispensing opening being located at or adjacent to a skin contacting surface provided on the blade unit adjacent the blade(s), such as at the guard surface in front of the blade(s) or at the cap surface behind the blade(s).

The fluid may be pressurised in the reservoir and the dispensing device can then take the form of an electrically actuable valve. However, a better control over the rate of delivery of fluid can be achieved with a system having an electrically driven pump to control the delivery of fluid. An electric pump can have a fast response, provide a constant flow rate and allow flexibility in controlling the flow. The pump motor can be connected to a power source, preferably a battery housed within the razor handle, by a switching device, the control device generating pulses of set duration, i.e. pulse width, for controlling the switching device.

A satisfactory dispensing of fluid can be achieved with the predetermined period of actuation in the range of from 0.1 to 2 seconds, more particularly 0.2 to 1 second. Most effective delivery of fluid can be obtained with the predetermined period of actuation from 0.3 to 0.6 seconds, such as about 0.4 seconds. The control device can be arranged to ensure a delay between successive actuations of the dispensing device to restrict the delivery of fluid when several short shaving strokes are executed in quick succession with the razor. A delay of at least one second is suggested, such as a delay in the range of 1 to 10 seconds, or more suitably from 2 to 6 or 8 seconds. For most razor users a delay of about 4 seconds may be expected to produce good results while still allowing adequate delivery of fluid. It is also possible for the control device to limit the delivery of fluid by being so arranged that the dispensing device is not actuated every time that the razor is brought into contact with the skin for performing a shaving stroke. Thus, the control device may be arranged to be actuated every second, third or fourth shaving stroke. Such an arrangement may be particularly preferred if the blade unit includes an absorbent or porous material to which the fluid is delivered and which serves to ensure a gradual application of the fluid to the skin during execution of a shaving stroke. The control device can also be adapted to take account of the duration of the shaving strokes and/or the number of shaving strokes being completed in order to control the delivery of fluid accordingly. Furthermore, a longer period of actuation of the dispensing device may be provided for at the beginning of shaving, and, for example by reverse operation of a dispensing pump, at the end of shaving suck back action to draw fluid back from the blade unit may be included.

The blade unit of the razor is preferably a detachable cartridge that is intended to be replaced when the blade or blades have become dulled. The cartridge and handle may have a coupling arrangement to complete the fluid delivery path. Alternatively, a dispensing head, such as a spray head, may be carried on the handle independently of the cartridge for delivery of the fluid, for example directly in front of the guard of the cartridge. If a spray head is provided the delivery of fluid can be controlled by means of an arrangement based on "ink jet" technology.

The fluid dispensed in a preferred embodiment comprises a liquid lubricant, in particular silicone oil for which a delivery rate of less than 3 g/min is appropriate. Nonetheless a wide variety of fluid shaving enhancement products may be applied to the skin during shaving using a razor in accordance with the invention, including fluids exhibiting the properties or qualities or any one or more of the following:—

(i) shaving soap;
(ii) lubricant;
(iii) skin conditioner;
(iv) skin moisturiser;
(v) hair softener or conditioner to facilitate cutting;
(vi) fragrance;
(vii) skin cleanser;
(viii) bacterial or medicinal lotion; and
(ix) blood coagulant or the like for beneficial treatment of minor cuts and abrasions which can be suffered during shaving.

The control device could comprise a mechanical switch, but in a preferred razor construction the control device is proximity or touch sensitive and includes a sensor element so located that the sensor element is brought into close proximity to or into contact with the skin being shaved during the performance of a shaving stroke, the dispensing device being actuated in response thereto.

In the case of a safety razor equipped with a proximity sensitive control device, the dispensing device may be activated when the blade unit is within a distance of not more than about 10 mm from the body, such as a distance of 5 mm or less. Proximity switches operated by light, infrared or radio frequency radiation may be used. In a particular embodiment of the invention a touch sensitive control device is employed whereby actuation occurs immediately upon the blade unit making contact with the skin. The sensor element located on the blade unit is preferably an electrode and can conveniently be constituted by at least one blade of the blade unit. A separate electrode can however, be provided instead if preferred. The blade unit may include a plastic frame at least part of which may be made of conductive plastics to provide an electrode and/or to provide electrical connection to the electrode. Electrical connection to the electrode can also be achieved by plating or coating the blade unit frame with an electrically conductive material or equipping the blade unit with one or more conductive strips for this purpose.

In a preferred embodiment a second electrode is provided and the control device is sensitive to a change in an electrical parameter, such as the electrical resistance or capacitance between the electrodes. More particularly the second electrode is arranged so as to be, in use, in close proximity to or in contact with the body of the user, and is conveniently provided as part of the handle for contact with the hand of a user holding the razor.

The control device may comprise a signal generator arranged to generate a pair of electrical signals, a comparator arranged to compare said pair of electrical signals and to provide an output indicative of a predetermined change in the relationship between said pair of signals, and means responsive to said comparator output to actuate the dispensing device, the predetermined change occurring when both electrodes are in close proximity to or in contact with the skin of the razor user.

In a particular embodiment the signal generator is an oscillator, the pair of electrical signals being a pair of oscillating signals, and first and second capacitances are arranged to be charged by the respective oscillating signals, the electrodes being arranged such that the first capacitance is charged slower than the second capacitance when the razor is moved by a user into a condition where both electrodes are in close proximity to or in contact with the skin e.g. due to a further capacitance being coupled in parallel with said first capacitance.

A razor according to the invention preferably includes an electric power source, especially a battery, to supply electric power for the control means and the dispensing device, as well as a switch device arranged to connect or interrupt the supply of electric power from said electric power source to the control device and the pump or other dispensing device. The switch device may be on the exterior of the appliance and manually operable by the user. Alternatively it may be arranged to interact with an associated storage tray to interrupt the supply of electric power from said electric power source when inserted into the storage tray and to connect the supply when removed therefrom. The storage tray can be generally of the same form as that described in U.S. Pat. No. 5,782,346.

DESCRIPTION OF THE DRAWINGS

To facilitate a clear understanding of the invention an embodiment of a safety razor is described in detail below with reference to the accompanying drawings, in which:—

DESCRIPTION OF A PREFERRED EMBODIMENT

Figure 1:
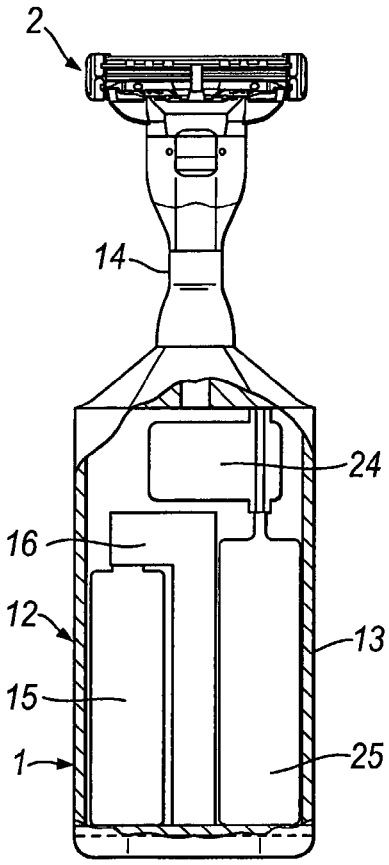
FIG. 1 shows the safety razor in rear elevation.

The safety razor illustrated in the drawings has a handle 1 and a blade unit or cartridge 2 detachably mounted on the upper end of the handle. The blade unit includes a generally rectangular frame 3, and a plurality of blades 4, e.g. 3, 4 or 5 blades, with substantially parallel sharp cutting edges, disposed in the frame and held in place by metal clips 5 positioned around the frame 3 at the opposite ends of the blade unit 2. A guard structure 6 including a strip of elastomeric material is provided on the frame for contacting the skin in front of the blades, and a cap structure 7 is provided on the frame for contacting the skin behind the blades during the performance of a shaving stroke. The frame is pivotally carried on yoke member 8 having a pair of arms 9 which extend from a hub 10 and are journalled in opposite ends of the frame 2 so that the blade unit 2 can pivot relative to the handle 1 about an axis substantially parallel to the blade edges. The hub 10 is connected detachably to the end of the handle 1. As so far described the razor is of a known construction and for further details reference may be made to earlier patent publications, one example of which is WO 97/37819.

Figure 5:
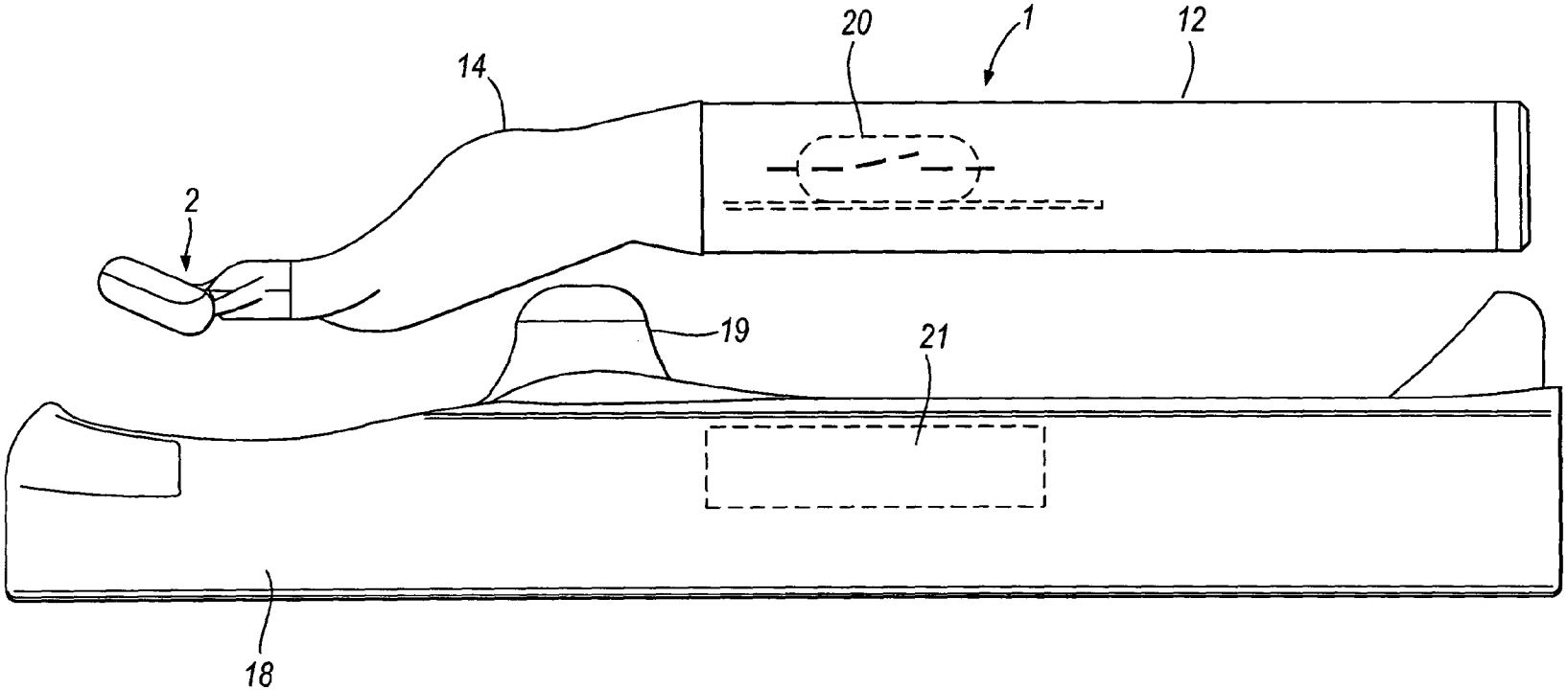
FIG. 5 is a side elevation showing a razor holder in the form of a tray on which the razor is stored during periods of non-use, the razor being shown separated from the storage tray at a small distance.
Figure 6:
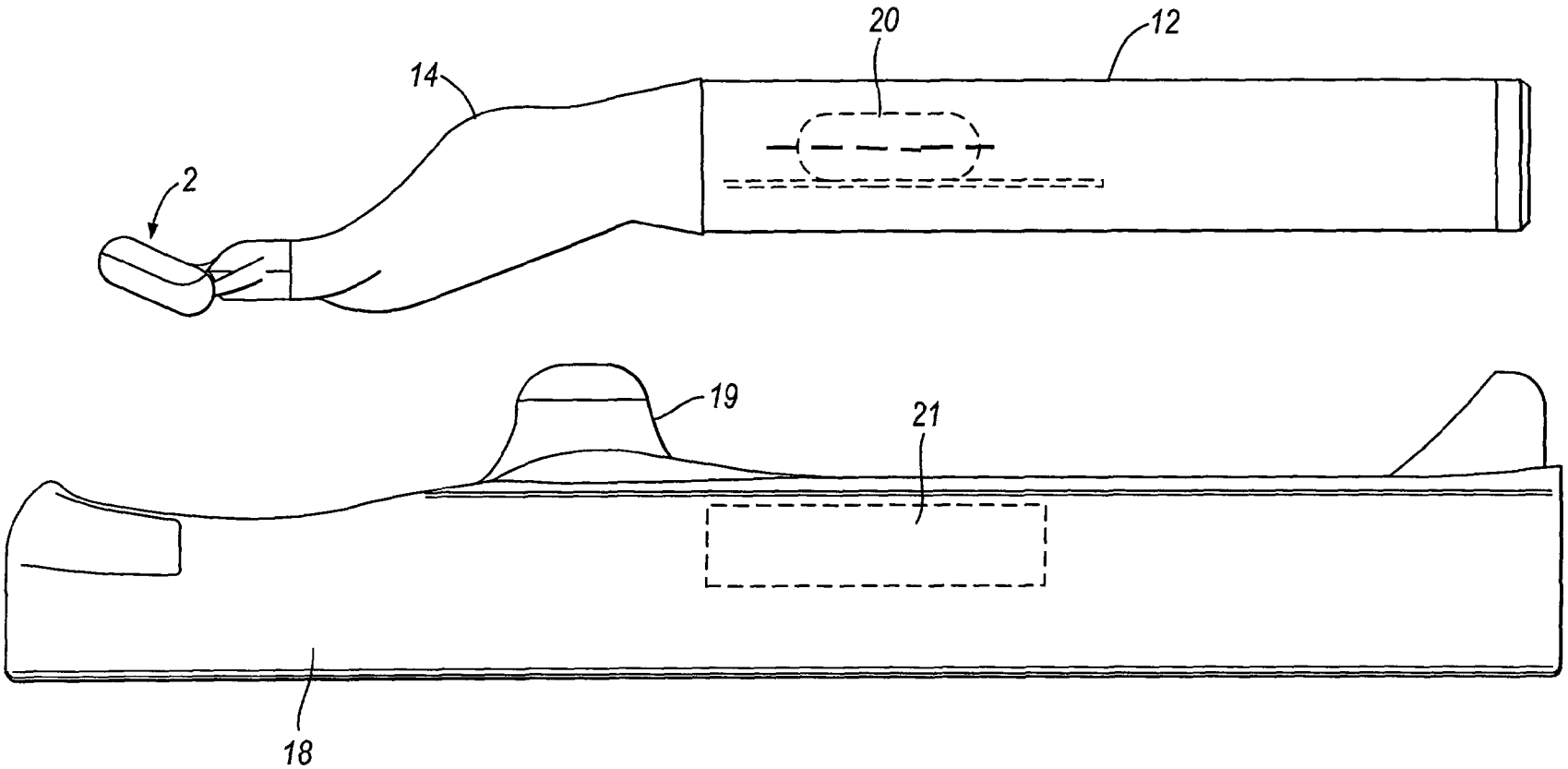
FIG. 6 is a side elevation corresponding to claim 3, but showing the razor at a greater distance from the storage tray.

The razor handle includes a main portion 12 intended to be gripped in the hand and a neck 14 extending upwardly from the main portion and to the free end of which the blade unit 2 is attached. The main or gripping portion 12 of the handle 1 includes an electrically conductive, e.g. metal casing 13 which serves as an electrode for electrical contact with the hand of a user as described in more detail below. Housed within a battery compartment in the handle is a replaceable or rechargeable battery 15. Also housed within the handle is electronic control device 16. The battery 15 is electrically connected to the control device 16 through a power switch which is operable to interrupt power supply to the control device for conserving battery energy during periods when the razor is not being used. The power switch could be located on the handle for manual operation, but in a preferred construction the power switch is arranged to be actuated by removing the razor from, and returning it to a razor holder on which the razor is intended to be stored when not in use. A known form of razor holder consists of a tray 18 as shown in FIGS. 5 and 6, the tray 18 having on its upper side a saddle 19 adapted to receive and lightly grip the neck 14 of the razor handle 1. The razor handle 1 could be equipped with a mechanical switch so arranged for cooperation with the storage tray 18 that the switch is operated automatically when the razor is lifted away from the storage tray 18 for power to be supplied to the switching device 16 from the battery 15, and to be actuated upon replacement of the razor on the tray to interrupt the power supply. In the preferred embodiment essentially the same result is achieved by a power switch in the form of a reed switch 20 located within the handle 1, the storage tray 18 being provided with a permanent magnet 21. When the razor is positioned close to the tray 18 the reed switch 20 is held open by the proximity of magnet 21 and there is no electrical power supply from the battery 15, as shown in FIG. 5, but when the razor is moved away from the tray the reed switch closes and electrical power supply to the control device 16, is established, as illustrated in FIG. 6.

Figure 2:
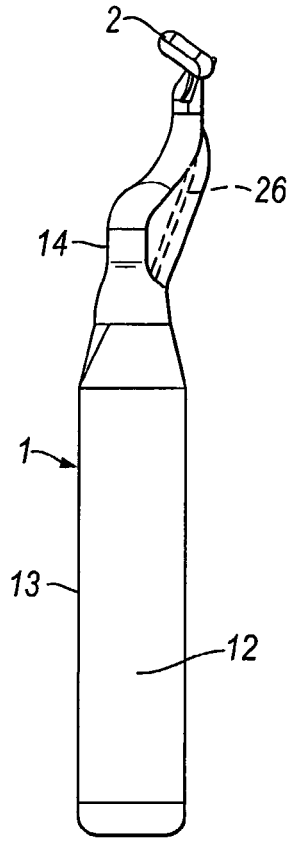
FIG. 2 shows the safety razor in side elevation.
Figure 3:
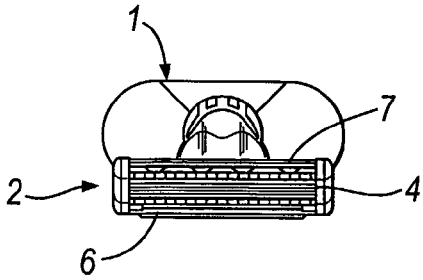
FIG. 3 shows the safety razor in front elevation.

The control device 16, in a manner described in detail below, controls actuation of an electric pump 24 (FIGS. 2 and 3) housed within the handle 1. The pump 24 has an inlet connected to a reservoir 25 accommodated in the interior of the handle 1 and in which a supply of lubricant fluid, namely silicone oil, is stored. The reservoir can be either replaceable or refillable. The outlet of the pump 24 is connected to a duct 26 that extends through the neck 14 of the razor handle. The duct 26 may connect with a duct formed in one or both arms 9 of the yoke member 8 for delivering oil to the cartridge 2 which has a dispensing opening located at or adjacent a skin contacting surface of the cartridge. Alternatively a separate connection can be provided between the handle and the cartridge for conducting lubricant supplied through the duct 26 to the cartridge. Suitably the cartridge may include an elongate manifold disposed between the guard 6 and the blades 4, the manifold having one or more dispensing slots extending along the cartridge parallel to the blades, for discharging the lubricant for application to the skin surface during shaving. The lubricant is metered to the dispensing slots by controlled actuation of the pump 24 as described below.

The control device 16 is configured to be touch sensitive so that the pump 24 is actuated when the blade unit of the razor is brought into contact with the body of the razor user, that is a person holding the razor handle 1. The blade unit 2 incorporates an electrode which is conveniently constituted by at least one and preferably includes all of the blades 4 of the blade unit. Electrical connection between the control device 16 and this electrode 4 is achieved by the neck 14 of the handle 1 having a contact 30 arranged to project through the hub 10 of the yoke member 8 and to bear against a contact strip 32 fixed to the rear of the blade unit, the contact strip 32 having lateral wings 33 which extend to and are conductively connected to the metal blade retention clips 5, and these clips in turn having contact with blades 4. Of course, it is not essential to use the blades 4 as an electrode and a separate electrically conductive element could be provided on the blade unit in a position for contacting the skin when the blade unit 2 performs a shaving stroke. The contact 30 makes constant electrical contact with the contact strip 32 so that the electrical continuity between the electrode at the blade unit is not interrupted even during pivoting of the blade unit 2 on the handle 1 as tends to occur as the blade unit is applied to and moved across the skin. The contact 30 conveniently takes the form of a spring-loaded plunger for resisting pivotal movement of the blade unit away from a predetermined rest position. The contact 30 is shown connected electrically to the control device 16 by a wire conductor 35 which is led through the neck 14 of the handle 1.

Of course there are other possibilities to ensure electrical connection of the electrode on the blade unit and the control device. For example, the frame 3 of the blade unit could be made of an electrically conductive material, such as a conductive plastics. Also the rear of the frame 3 could be plated, coated or printed with conductive material, have an adhesive metal foil applied to it, or have a metal element embedded therein, to provide electrical connection between the contact 30 and the clips 5, or to the electrode itself or another component in contact with the electrode. Alternatively the frame may include an injection moulded metal part to provide the conductive path between the electrode and the contact 30, or water held in capillary grooves may be sufficient to ensure the electrical continuity.

Figure 7:
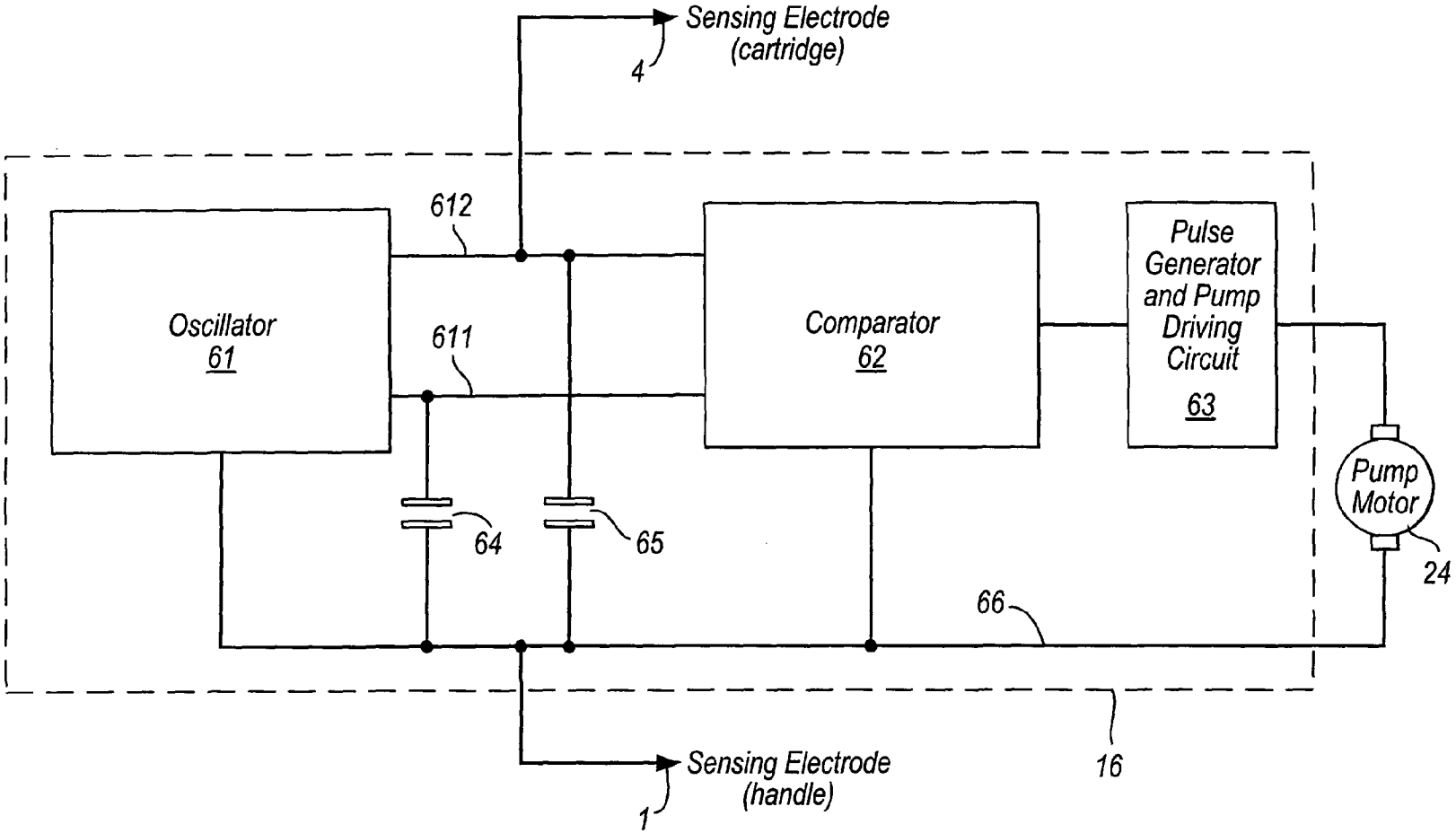
FIG. 7 is a block diagram of an electric control device incorporated in the razor.

FIG. 7 is a schematic diagram to illustrate the function of control device 16. As shown, control device 16 comprises an oscillator 61, a comparator 62, pulse generator and pump driving circuit 63, and first and second capacitors 64, 65. Control device 16 is additionally connected to two sensing electrodes constituted by the blades 4 as described above and the exterior casing 13 of the handle 1 respectively. The pulse generator and pump driving circuit 63 is connected to control the drive current to the motor of pump 24. As mentioned above, the power necessary to energise control device 16 is provided by battery 15 through a power switch. The power connections are omitted from FIG. 7 for clarity, it being understood that the following description of the operation of control device 16 is applicable to the condition when it is energised by the application of power from the battery.

Oscillator 61 is configured to provide two oscillating signals on output lines 611 and 612 respectively. Output lines 611 and 612 are connected to line 66, which serves as a ground line for the circuitry, via first and second capacitors 64,65 respectively. Lines 611 and 612 further provide a pair of inputs to comparator 62. In essence, the comparator 62 is sensitive to changes in the relationship between its two inputs. The sensor electrodes are connected such that the relationship between the two inputs to the comparator changes according to whether both or only one of the electrodes are in contact with the body of a user. Being sensitive to such a change, the comparator supplies a trigger signal to the pulse generator and pump device driver circuit 63 when both electrodes are brought into contact with the body of a user.

In more detail, it will be seen in FIG. 7 that line 612 is additionally connected to one of the sensing electrodes. When there is no effective electrical connection between the two electrodes, the signals output by oscillator 61 on lines 611 and 612 have a first predetermined relationship at the input to comparator 62. When both of the sensing electrodes are in contact with the body of a user some additional electrical connection is made between line 612 and ground line 66. This may be for instance capacitance additional to capacitor 65 and/or for electrical resistance. In any event, the additional connection is effective to alter the characteristics of the signal on line 612 input to comparator 62. Accordingly the relationship between the two inputs change and the comparator 62 responds by producing a trigger signal to circuit 63 which in turn controls actuation of the pump 24.

As described above, control device 16 is responsive to both of the sensing electrodes being in contact with the body of the user. Depending upon the operating conditions of the device or the sensitivity of the comparator control device 16 may also be responsive to other conditions. In particular, if a user is holding the razor and is therefore in contact with one of the electrodes, it may be sufficient to bring the other electrode close to but not touching his or her body. The proximity of the other electrode to the body is sufficient in this case for an additional capacitance to appear between lines 612 and 66 and so cause the above described change in the signals on line 612. The sensitivity of the comparator or other circuit proximity can be set to determine the approximate distance from the body at which this effect will occur. This may for instance be set to be approximately 10 mm.

Figure 4:
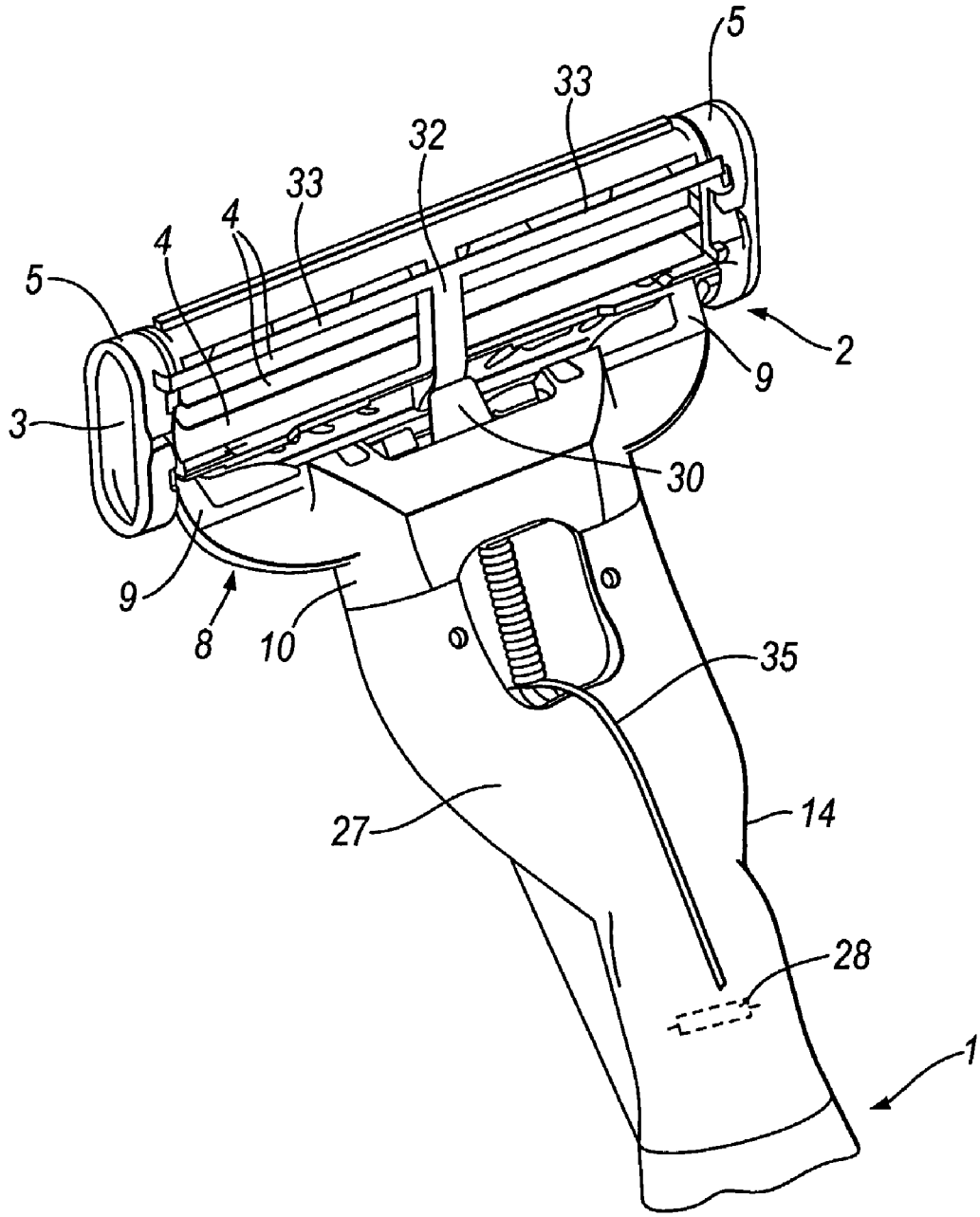
FIG. 4 is a rear perspective view showing the upper end of the handle and the blade cartridge.

Further, control means 16 may be arranged to provide some form of output whenever it is energised by the power switch 20 connecting the battery power to the control means. A lighting device, such as a light emitting diode 28 (FIG. 4), denoted LED1 in FIG. 8, may be arranged to be lit whenever the power switch is "on". This or a further lighting device may be arranged to flash when battery power is low, or when the liquid level in the reservoir 25 is low.

Figure 8:
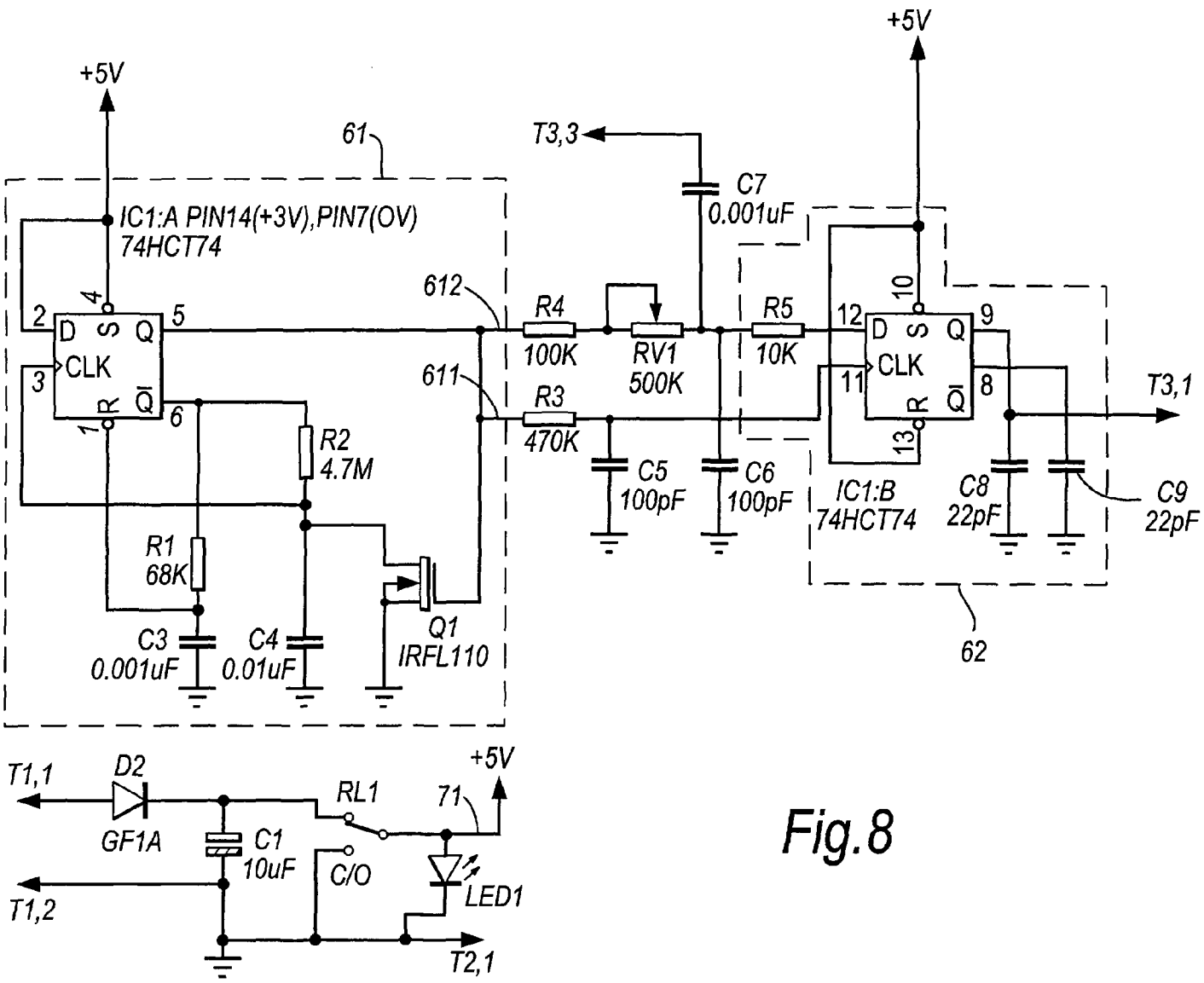
FIG. 8 shows an example of a specific switching device.
Figure 9:
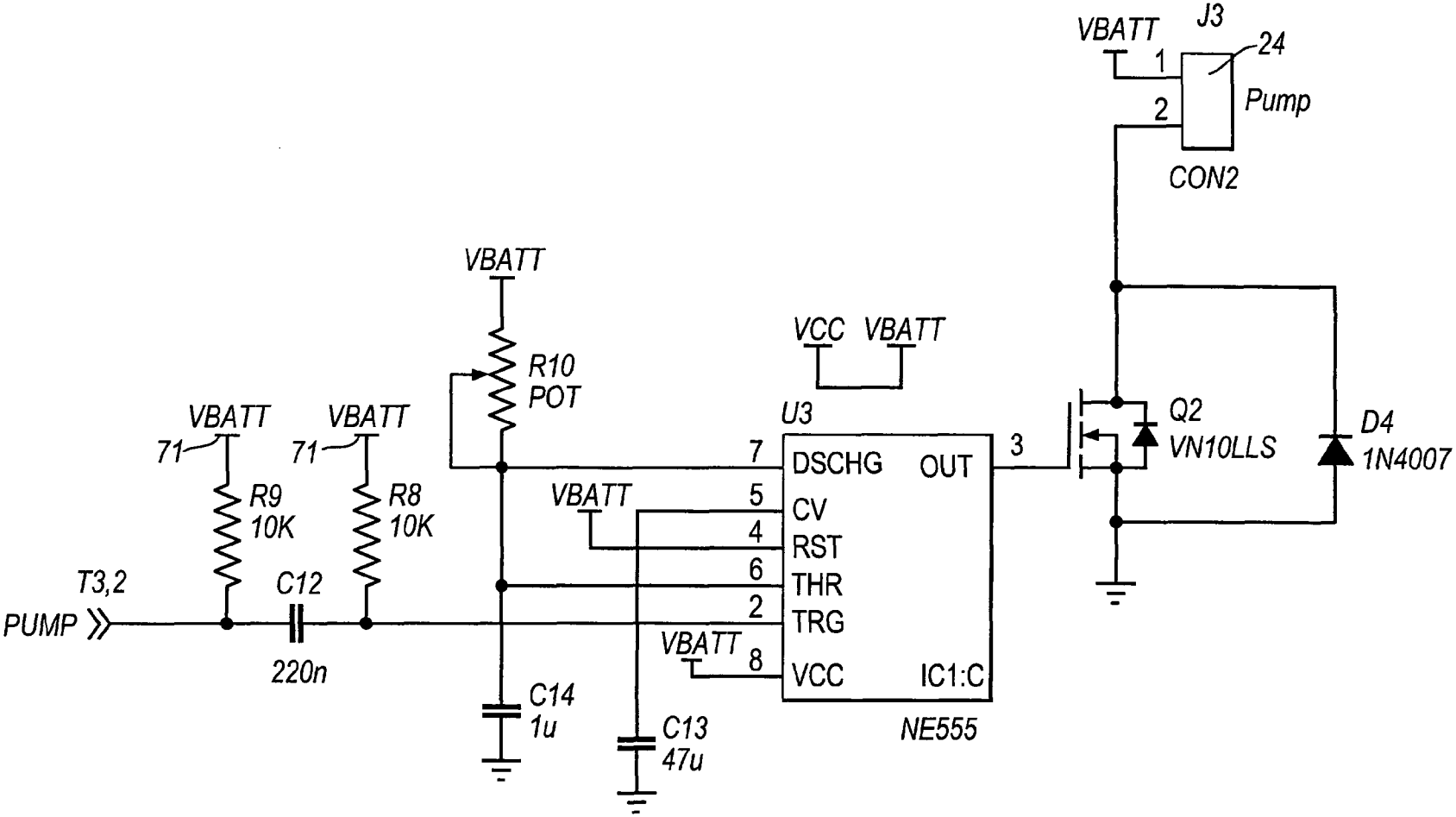
FIG. 9 shows a specific example of a pulse generator and pump driving circuit.

FIGS. 8 and 9 illustrate a circuit implementation of the control device 16 of FIG. 7. This is shown merely by way of illustration and many other ways of implementing the functionality of the control device 16 are possible. In FIGS. 8 and 9, IC1:A, IC1:B and IC1:C are integrated circuit devices and other components are resistors, capacitors, diodes and transistors designated by the prefixes R, C, D and Q with exemplary values being shown in the Figure.

In FIG. 8, RL1 is the power switch described earlier and is a reed switch operated by a magnet in the tray designed to hold the device when not in use. When the device is removed from the tray, the switch RL1 is in the position illustrated such that the power from battery 15 connected to terminals T1,1 and T1,2 is applied to the circuit via the +5V rail, 71, and the light emitting diode LED 1 is illuminated. Terminal T2,1 is connected to the exterior casing 13 of the handle 1 of the device to provide one of the two electrodes and the "ground" for the circuit.

IC1:A forms the heart of the oscillator 61 and is configured with associated resistors R1,R2, capacitors C3,C4 and transistor Q1 to provide an oscillation output on lines 611 and 612. These provide the inputs to comparator 62, at the heart of which IC1:B, via resistor and capacitor networks R4,RV1 and C6, and R3 and C5.

Within each cycle of the oscillating signal, when the signal on line 611 goes high, capacitor C5 starts to charge via resistor R3. Therefore, a rising signal is applied to the clock input of IC1:B. At a certain level of this input signal, the clock input of IC1:B changes from low to high. The frequency of the oscillation and the charging rate of capacitor C5 are set such that the "high" clock input to IC1:B is reached during each oscillator cycle. As is well known whenever the clock signal goes high, the value of the "D" input to IC1:B is clocked through to the Q output, with $\overline{Q}$ being the inverse.

Also within each cycle of the oscillating signal, when the signal on line 612 goes high, capacitor C6 starts to charge via resistor R4 and variable resistor RV1. As capacitor C6 has the same value as capacitor C5, when nothing is connected to terminal T3,3 and RV1 is set so that the combination of R4 and RV1 is equivalent to R3, the charging rate of the two capacitors is the same. Therefore RV1 can be used to trim the circuit to ensure that, in this condition, C6 charges at least as quickly as C5 such that when the clock input to IC1:B goes high, the 'D' input from line 612 is also high. In this condition Q is always high.

Terminal T3,3 is connected to the electrode in the razor cartridge. Accordingly, when that electrode is brought into contact with or close proximity to the body of a user who is holding the handle connected to terminal T2,1, an additional path to ground is made, via a capacitor C7 and whatever resistance and capacitance the user's body has. This has the effect of slowing the charging rate of capacitor C6 such that, when the clock input of IC1:B goes high, the 'D' input is still low and so Q goes low. As described in more detail below the pulse generator and pump drive circuit 63 shown in FIG. 9 is responsive to a falling edge, and thus the transition of signal Q to low provides a suitable trigger signal.

Referring to FIG. 9, IC1:C is a timer circuit (in this embodiment a standard 555 timer IC) which provides the basis of a pulse generator and the trigger input TRG of which is capacitively coupled by capacitor C12 with a terminal T3,2 that is connected to the output terminal T3,1 of the comparator 62. Each side of the capacitor C12 is connected to the +5V rail 71 through a respective resistor R8, R9 so that when the Q output of the comparator 62 goes low as described above, a trigger signal is delivered to the trigger input TRG of IC1:C which immediately responds by causing a predetermined voltage pulse to be emitted at the output OUT of IC1:C. The timing circuit (R10, C14) determines the duration, i.e. the pulse width, of the output pulse in accordance with a voltage level supplied to a threshold input THR of IC1:C. The threshold voltage level, and hence the duration of the output pulse, is adjustable and is set by the adjustment of a potentiometer R10 that is wired as a variable resistor connected on one side to the +V rail and on the other side to ground via a capacitor C14. Thus, the output pulse is interrupted after the pulse duration. Although not provided for in the circuit as illustrated, there could then be a delay before the pulse generator can be triggered to emit a further output pulse. A circuit incorporating a microprocessor control could provide this as well as other additional control parameters. The output pulse of the pulse generator is supplied to the control input of a switching device, shown to be a field effect transistor (FET) Q2, which switches on and off the supply of battery power to the motor of pump 24. A diode D4 is connected in parallel with FET Q2 to protect against any back EMF generated by the pump motor. It will be understood that the pump 24 is actuated for the predetermined duration of the output pulse generated by the pulse generator, for metering a corresponding quantity of fluid to the dispensing outlet at the blade unit 2, when the blade unit is moved into contact with the skin of a user holding the razor by the handle 1. A suitable period of actuation of the pump is from 0.1 to 2 seconds, more particularly 0.2 to 1 second, and most preferably 0.3 to 0.6 seconds. An actuation period of 0.4 seconds is believed to produce an acceptable dispensing rate for lubricating fluid during shaving. The razor may be equipped with a control element to allow the razor user to adjust the actuation period between certain limits to suit personal preferences, by varying the setting of the variable register R10. When a delay is ensured between successive actuations it may be at least as long as the period for actuation and may be from 1 to 10 seconds, such as 2 to 6 or 8 seconds, a delay of around 4 seconds being considered appropriate for most shavers.

It should be understood that the foregoing description of the preferred embodiment is given by way of non-limiting example only and that modifications are possible without departing from the scope of the invention as defined by the claims which follow. As an example of one possible modification it is mentioned that the conductive casing 13 of the handle could be provided with a thin covering layer of insulating material so that there is a high capacitance and high resistance coupling between the hand of the user and the handle electrode. Furthermore, if desired a manually operable switch mechanism can be included on the razor handle and be connected electrically in series with the switch 20, for use by a user who prefers not to use the storage tray 18 for holding the razor when it is not being used. This switch, or a different switch, such as an electronic toggle switch which turns on and/or off after a certain delay may be included in order to allow the razor user to select a non-dispensing mode, for example, at the beginning of a shave when a shaving foam or gel has been applied to the skin.

The invention claimed is:

1. A razor comprising a fluid delivery system for conducting fluid from a reservoir to a dispensing opening for application to the skin during shaving, the delivery system including an electrically actuable dispensing device to control delivery of the fluid, and a control device for controlling actuation of the dispensing device, wherein the control device is in proximity or is touch sensitive and includes a sensor element arranged to be brought into contact with or into close proximity to the skin being shaved during the performance of a shaving stroke wherein the sensor element comprises a first electrode and a second electrode and wherein the control device is arranged to produce a control signal to actuate the dispensing device when the razor is brought into contact with the skin for shaving and to deactuate the dispensing device after a predetermined period of actuation and wherein the control device is sensitive to a change in an electrical parameter between the electrodes, wherein said second electrode is arranged so as to be in close proximity to or in contact with the body of the user and wherein said second electrode is provided as part of the razor handle.

2. A razor according to claim 1 wherein the electrical parameter is electrical resistance.

3. A razor according to claim 1 wherein the electrical parameter is electrical capacitance.

4. A razor according to claim 1, wherein said control device comprises signal generator arranged to generate a pair of electrical signals, and a comparator arranged to compare said pair of electrical signals and to provide an output indicative of a predetermined change in the relationship between said pair of signals, there being an output produced to actuate said flow device;

wherein said electrodes are arranged such that movement of the razor by a user into a condition where both electrodes are in close proximity to or in contact with the body causes said predetermined change.

5. A razor according to claim 4, wherein said signal generator is an oscillator and said pair of electrical signals is a pair of oscillating signals.

6. A razor according to claim 5, wherein said control device comprises first and second capacitances respectively arranged to be charged by said pair of oscillating signals, said electrodes being arranged such that the first capacitance is charged slower than the second capacitance when the appliance is moved by a user into a condition where both electrodes are in close proximity to or in contact with the body.

7. A razor according to claim 6, wherein said first and second electrodes are arranged to couple a further capacitance in parallel with said first capacitance when the razor is moved by a user into a condition where both electrodes are in close proximity to or in contact with the body.

* * * * *